US010240523B2

(12) United States Patent
Amakawa et al.

(10) Patent No.: US 10,240,523 B2
(45) Date of Patent: Mar. 26, 2019

(54) HEAT PUMP

(71) Applicant: Yanmar Co., Ltd., Osaka-shi, Osaka (JP)

(72) Inventors: Shohei Amakawa, Osaka (JP); Keisuke Taharabaru, Osaka (JP)

(73) Assignee: Yanmar Co., Ltd., Osaka-shi (JP)

( * ) Notice: Subject to any disclaimer, the term of this patent is extended or adjusted under 35 U.S.C. 154(b) by 0 days.

(21) Appl. No.: 15/528,149

(22) PCT Filed: Nov. 18, 2015

(86) PCT No.: PCT/JP2015/082456
§ 371 (c)(1),
(2) Date: May 19, 2017

(87) PCT Pub. No.: WO2016/080462
PCT Pub. Date: May 26, 2016

(65) Prior Publication Data

US 2017/0328275 A1 Nov. 16, 2017

(30) Foreign Application Priority Data

Nov. 21, 2014 (JP) ..... 2014-237142

(51) Int. Cl.
*F02B 63/04* (2006.01)
*F24F 1/22* (2011.01)
*F24F 1/44* (2011.01)

(52) U.S. Cl.
CPC ..... *F02B 63/044* (2013.01); *F24F 1/22* (2013.01); *F24F 1/44* (2013.01); *F02B 2063/045* (2013.01)

(58) Field of Classification Search
CPC ..... F02B 63/044; F02B 2063/045
(Continued)

(56) References Cited

U.S. PATENT DOCUMENTS 3,960,322 A * 6/1976 Ruff ..... F03G 6/00 62/228.1
4,160,880 A * 7/1979 Brey ..... H04Q 1/064 361/827

(Continued)

FOREIGN PATENT DOCUMENTS

JP 11-337154 A 12/1999
JP 2002-106929 A 4/2002

(Continued)

OTHER PUBLICATIONS

International Preliminary Report on Patentability (PCT/IB/338 & PCT/IPEA/409) issued in PCT Application No. PCT/JP2015/082456 dated Jun. 22, 2017, including English translation of document C2 (Japanese-language Written Opinion (PCT/ISA/237)) previously filed on May 19, 2017 (7 pages).

(Continued)

*Primary Examiner* — Tulsidas C Patel
*Assistant Examiner* — Charles Reid, Jr.
(74) *Attorney, Agent, or Firm* — Norton Rose Fulbright US LLP

(57) ABSTRACT

The heat pump includes a terminal block box housing a terminal block for supplying an electric power to at least one electrical device. The terminal block box is supported and made rotatable in a horizontal direction by a hinge. The terminal block box is located between a portion of side plates of a package and electromagnetic valves located on the side of the portion of the side plates. As a result, maintain of electrical devices can easily be performed.

10 Claims, 6 Drawing Sheets

(58) Field of Classification Search
USPC ..... 290/1 A
See application file for complete search history.

(56) References Cited

U.S. PATENT DOCUMENTS

| | | | | |
|---|---|---|---|---|
| 5,495,723 | A * | 3/1996 | MacDonald | F24D 17/02 62/183 |
| 6,041,816 | A * | 3/2000 | Hiramatsu | F15B 13/0817 137/271 |
| 8,963,348 | B2 * | 2/2015 | Kawakita | F02B 63/044 123/2 |
| 2004/0065095 | A1 * | 4/2004 | Osborne | F24F 3/00 62/160 |
| 2011/0057454 | A1 | 3/2011 | Kawakita et al. | |
| 2012/0272669 | A1 * | 11/2012 | Blanton | F25B 5/02 62/89 |
| 2015/0241085 | A1 * | 8/2015 | Justus | F24H 9/148 290/2 |
| 2015/0292779 | A1 * | 10/2015 | Chen | F24D 3/18 62/160 |
| 2017/0115025 | A1 * | 4/2017 | Mowris | F24F 11/053 |

FOREIGN PATENT DOCUMENTS

| | | | |
|---|---|---|---|
| JP | 2007-46793 | A | 2/2007 |
| JP | 2012-215305 | A | 11/2012 |
| JP | 5134428 | B2 | 1/2013 |

OTHER PUBLICATIONS

International Search Report (PCT/ISA/210) issued in PCT Application No. PCT/JP2015/082456 dated Jan. 12, 2016 with English translation (3 pages).
Japanese-language Written Opinion (PCT/ISA/237) issued in PCT Application No. PCT/JP2015/082456 dated Jan. 12, 2016 (3 pages).

* cited by examiner

HEAT PUMP

TECHNICAL FIELD

The present invention relates to a heat pump and, for example, to an engine-driven heat pump using a gas engine etc. and an electrically-driven heat pump.

BACKGROUND ART

Conventional control box arrangement structures include a structure described in Japanese Patent No. 5134428 (Patent Document 1). This control box arrangement structure is mounted on a cogeneration apparatus.

In this control box arrangement structure, a control box and an operation surface of an inverter are arranged to overlap in a depth direction of the cogeneration apparatus. The control box is made openable/closable by a hinge.

PATENT DOCUMENT

Patent Document 1: Japanese Patent 5134428

SUMMARY OF THE INVENTION

Problem to be Solved by the Invention

Patent Document 1 described above discloses a control box arrangement structure in a cogeneration apparatus. However, the type, number, and structure of electrical components in a heat pump are completely different from the type, number, or structure of electrical components in the cogeneration apparatus, so that even when a reference is made to Patent Document 1, knowledge cannot be acquired on a terminal block box arrangement structure facilitating maintenance of the electrical devices in the heat pump.

Therefore, a problem to be solved by the present invention is to provide a heat pump in which maintenance of electrical devices can easily be performed.

Means for Solving Problem

To solve the problem, a heat pump of the present invention is a heat pump having an outdoor unit with a compressor, an outdoor heat exchanger, and a plurality of electrical devices including a plurality of on-off valves and a plurality of expansion valves housed in a package, the heat pump comprising:

a terminal block box housing a terminal block for supplying an electric power to at least one of the electrical devices, wherein the terminal block box is located between a portion of side plates of the package and some of the plurality of electrical devices located on the side of the portion of the side plates, and the terminal block box is supported and made rotatable in a horizontal direction by a hinge.

Effect of the Invention

According to the heat pump of the present invention, the maintenance of the electrical devices can more easily be performed.

EMBODIMENTS FOR CARRYING OUT THE INVENTION

Figure 1:
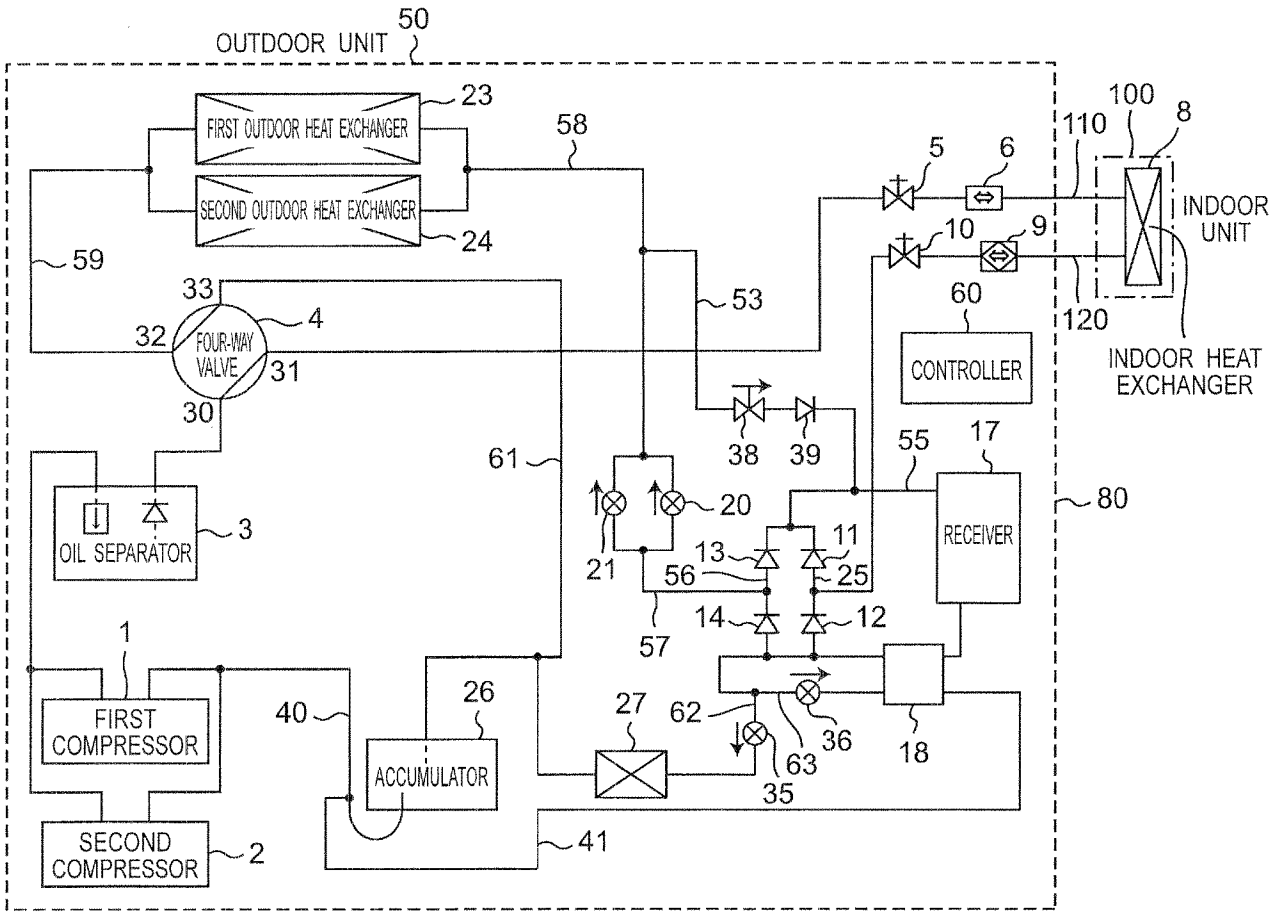
FIG. 1 is a simplified refrigerant circuit diagram of a gas-engine-driven heat pump according to an embodiment of the present invention.

A heat pump according to an aspect of the present invention is a heat pump having an outdoor unit with a compressor, an outdoor heat exchanger, and a plurality of electrical devices including a plurality of on-off valves and a plurality of expansion valves housed in a package, the heat pump comprising a terminal block box housing a terminal block for supplying an electric power to at least one of the electrical devices, wherein the terminal block box is located between a portion of side plates of the package and some of the plurality of electrical devices located on the side of the portion of the side plates, and the terminal block box is supported and made rotatable in a horizontal direction by a hinge.

It is noted that when a wording (expression) related to height such as a horizontal direction, a vertical direction, and a height direction is used in this description, the wording refers to a direction etc. in the state of the outdoor unit placed on the horizontal plane in a posture in a usage state.

According to the embodiment of the present invention, since the terminal block box is located between a portion of side plates of the package and some electrical devices located on the side of the portion of the side plates and the terminal block box is supported and made rotatable in a horizontal direction by a hinge, these electrical devices can easily be exposed to the outside by properly rotating the terminal block box (can be allowed to face the outside). Therefore, by simply properly rotating the terminal block box, a user can access these electrical devices and may easily perform the maintenance of these electrical devices.

A remote monitoring apparatus may be housed in the terminal block box.

It is noted that the remote monitoring apparatus is defined as a device for transmitting a signal indicative of a state of at least one device of the heat pump to the outside of the heat pump by wire or wireless.

According to such a configuration, it is not necessary to newly provide an arrangement space of the remote monitoring apparatus in an arrangement space of various electrical devices having large volumes. Therefore, the arrangement space of various electrical devices can be made smaller. Additionally, since the remote monitoring apparatus is housed in the terminal block box, the arrangement position of the remote monitoring apparatus can easily be identified, and the maintenance of the remote monitoring apparatus can easily be performed.

While the package of the outdoor unit is removed, the plurality of electrical devices may have one or more electromagnetic valves capable of facing the outside (capable of being accessed from the outside) and one or more electronic expansion valves capable of facing the outside (capable of being accessed from the outside) on the side disposed with the terminal block box in the depth direction; some electrical devices capable of facing the terminal block box may have at least one of the electromagnetic valves capable of facing the outside; and the terminal block box may be located at a position higher than all the electronic expansion valves facing the outside.

Since the electronic expansion valves expand a refrigerant, dew condensation easily occurs on the surfaces of the electronic expansion valves. The volumes of the electronic expansion valves are often larger than the volumes of the electromagnetic valves.

According to such a configuration, since all the electronic expansion valves facing the outside are present below the terminal block box, the moisture sensitive electronic components stored in the terminal block box and a larger number of the electrical devices can be located at positions higher than the electronic expansion valves facing the outside. Therefore, the electronic components stored in the terminal block box and a larger number of the electrical devices can be protected from the dew condensation occurring on the surfaces of the electronic expansion valves facing the outside.

The devices capable of facing the terminal block box via only a clearance include the electromagnetic valves, while the electronic expansion valves are not included. Therefore, the electromagnetic valves and the electronic expansion valves can easily be identified, and maintenance of a specific valve can easily be performed.

The present invention will now be described in detail with a shown embodiment.

FIG. 1 is a simplified refrigerant circuit diagram of a gas-engine-driven heat pump according to an embodiment of the present invention.

As shown in FIG. 1, this heat pump includes an outdoor unit 50, an indoor unit 100, a gas refrigerant pipe 110, and a liquid refrigerant pipe 120. This heat pump also includes a controller 60 for the outdoor unit 50. A dotted line denoted by reference numeral 80 of FIG. 1 indicates a package of the outdoor unit 50. As shown in FIG. 1, the gas refrigerant pipe 110 and the liquid refrigerant pipe 120 each connect the outdoor unit 50 and the indoor unit 100.

The outdoor unit 50 includes a first compressor 1, a second compressor 2, an oil separator 3, a four-way valve 4, a gas-side stop valve 5, a gas-side filter 6, a liquid-side filter 9, a liquid-side stop valve 10, a first check valve 11, a second check valve 12, a third check valve 13, a fourth check valve 14, a receiver 17, and a subcooling heat exchanger 18. The outdoor unit 50 also includes a first electronic expansion valve 20, a second electronic expansion valve 21, a first outdoor heat exchanger 23, a second outdoor heat exchanger 24, an accumulator 26, a sub-evaporator (refrigerant auxiliary evaporator) 27, a third electronic expansion valve 35, a fourth electronic expansion valve 36, an electromagnetic valve 38, and a fifth check valve 39. On the other hand, the indoor unit 100 has an indoor heat exchanger 8.

The controller 60 outputs control signals to the first compressor 1, the second compressor 2, the four-way valve 4, the first electronic expansion valve 20, the second electronic expansion valve 21, the third electronic expansion valve 35, the fourth electronic expansion valve 36, and the electromagnetic valve 38 to control these devices. Although not shown, the controller 60 is electrically connected through a signal line to each of these devices.

As shown in FIG. 1, the first compressor 1, the second compressor 2, the gas-side stop valve 5, the liquid-side stop valve 10, the gas-side filter 6, and the liquid-side filter 9 are provided in the package 80 of the outdoor unit 50. The first compressor 1, the second compressor 2, the gas-side stop valve 5, the liquid-side stop valve 10, the gas-side filter 6, and the liquid-side filter 9 are arranged in the same chamber defined by the package 80.

As shown in FIG. 1, the first compressor 1 and the second compressor 2 are arranged in parallel, and lines on the discharge side of the first and second compressors 1, 2 are connected to a refrigerant inlet of the oil separator 3. The refrigerant outflow side of the oil separator 3 is connected to a first port 30 of the four-way valve 4. A second port 31 of the four-way valve 4 is connected via the gas-side stop valve 5 and gas-side filter 6 to a port on the gas side of the indoor heat exchanger 8. The gas-side filter 6 is disposed on the indoor unit 100 side relative to the gas-side stop valve 5 and inside the package 80 of the outdoor unit 50.

A port on the liquid side of the indoor heat exchanger 8 is connected through the liquid-side filter 9 and the liquid-side stop valve 10 to a line 25 connecting a port on the refrigerant outflow side of the first check valve 11 and a port on the refrigerant inflow side of the second check valve 12. The liquid-side filter 9 is disposed on the indoor unit 100 side relative to the liquid-side stop valve 10 and inside the package 80 of the outdoor unit 50. A port on the refrigerant outflow side of the first check valve 11 is connected through a line 55 to a port on the refrigerant inflow side of the receiver 17. A port on the refrigerant outflow side of the receiver 17 is connected through the subcooling heat exchanger 18 to respective ports on the refrigerant inflow side of the second and fourth check valves 12, 14.

As shown in FIG. 1, a port on the refrigerant outflow side of the fourth check valve 14 and a port on the refrigerant inflow side of the third check valve 13 are connected by a line 56. The first and second electronic expansion valves 20, 21 are connected in parallel to a line 57 branched from the line 56. The first and second outdoor heat exchangers 23, 24 are connected in parallel to a line 58 led out from a side of the first and second electronic expansion valves 20, 21 different from the side connected to the check valves 13, 14. The first and second electronic expansion valves 20, 21 are connected in series to the first and second outdoor heat exchangers 23, 24.

A line 59 led out from a side of the first and second outdoor heat exchangers 23, 24 different from the side connected to the electronic expansion valves 20, 21 is connected to a third port 32 of the four-way valve 4. As shown in FIG. 1, a fourth port 33 of the four-way valve 4 is connected to the accumulator 26. The accumulator 26 is connected to the intake side of the compressors 1, 2.

The port on the refrigerant inflow side of the fourth check valve 14 is connected via the third electronic expansion valve 35 to the sub-evaporator 27. A side of the sub-evaporator different from the side connected to the fourth check valve 14 is connected to a line 61 connecting the fourth port 33 of the four-way valve and the accumulator 26.

A new line 63 is branched from the line 62 connecting the port on the refrigerant inflow side of the fourth check valve 14 and the third electronic expansion valve 35. The branched line 63 is connected through the fourth electronic expansion valve 36 to the subcooling heat exchanger 18. As shown in FIG. 1, the subcooling heat exchanger 18 is directly connected through a line 41 to a line 40 connecting the accumulator 26 and the compressors 1, 2. The refrigerant passing through the subcooling heat exchanger 18 passes through the subcooling heat exchanger 18 and then flows through the line 41 toward the compressors 1, 2.

As shown in FIG. 1, the line 58 connecting the outdoor heat exchangers 23, 24 and the electronic expansion valves 20, 21 is branched, and a line 53 branched from the line 58 is connected to the line 55 connecting the first and third check valves 11, 13 to the receiver 17. The electromagnetic valve 38 and the fifth check valve 39 are arranged on the path of the branched line 53. As shown in FIG. 1, the electromagnetic valve 38 is located closer than the fifth check valve 39 to the outdoor heat exchangers 23, 24 on the line 53. The controller 60 controls the electromagnetic valve 38 to a fully-opened or fully-closed state.

In the configuration described above, this heat pump performs cooling and heating operations as follows.

First, in the heating operation, the controller 60 controls the four-way valve 4 to connect the first port 30 and the second port 31 of the four-way valve 4 and connect the third port 32 and the fourth port 33.

In the heating operation, the high pressure refrigerant gas discharged from the compressors 1 and 2 first flows into the oil separator 3. The oil separator 3 separates a lubricating oil of the compressors 1, 2 from the refrigerant gas. Although not described in detail, the lubricating oil separated from the refrigerant gas by the oil separator 3 is returned to the compressors 1, 2 through a line not shown.

After passing through the oil separator 3, the refrigerant gas passes through the four-way valve 4, the gas-side stop valve 5, and the gas-side filter 6 in this order and flows into the indoor heat exchanger 8. The gas-side stop valve 5 is a valve manually opened and closed (by using a tool in some cases). The gas-side stop valve 5 is closed mainly when the outdoor unit 50 is connected to the indoor unit 100 at the time of installation. The gas-side stop valve 5 plays a role of preventing a foreign matter from the outside from entering the outdoor unit 50 at the time of installation. The gas-side filter 6 plays a role of removing a foreign matter from the outside at the time of installation. The gas-side filter 6 is provided for protecting the outdoor unit 50.

The gas refrigerant gives heat to the indoor heat exchanger 8 and thereby liquefies itself into a liquid refrigerant. Subsequently, the liquid refrigerant flows via the liquid-side filter 9, the liquid-side stop valve 10, and the first check valve 11 in this order into the receiver 17. The liquid-side stop valve 10 is a valve manually opened and closed (by using a tool in some cases). The liquid-side stop valve 10 is closed mainly when the outdoor unit 50 is connected to the indoor unit 100 at the time of installation. The liquid-side stop valve 10 plays a role of preventing a foreign matter from the outside from entering the outdoor unit 50 at the time of installation. The liquid-side filter 9 plays a role of removing a foreign matter from the outside at the time of installation. The liquid-side filter 9 is provided for protecting the outdoor unit 50.

The receiver 17 plays a role of storing the liquid refrigerant. Subsequently, the liquid refrigerant goes through the bottom of the receiver 17, passes through the subcooling heat exchanger 18, runs through the fourth check valve 14, and flows toward the first and second electronic expansion valves 20, 21.

The pressure of the liquid refrigerant coming out from the bottom of the receiver 17 becomes lower due to a pressure loss through a path than the pressure of the liquid refrigerant on the outflow side of the second check valve 12 and the pressure of the liquid refrigerant on the outflow side of the first and third check valves 11, 13. As a result, basically, the liquid refrigerant going through the bottom of the receiver 17 does not pass through the second check valve 12 and the third check valve 13.

Subsequently, the liquid refrigerant is expanded by the first and second electronic expansion valves 20, 21 and is sprayed and atomized. The opening degrees of the first and second electronic expansion valves 20, 21 are freely controlled by the controller 60. The pressure of the refrigerant is high before passing through the first and second electronic expansion valves 20, 21 and becomes low after passing through the first and second electronic expansion valves 20, 21.

Subsequently, the atomized damp liquid refrigerant exchanges heat with outside air through the first and second outdoor heat exchangers 23, 24 and gasifies due to the heat given from the outside air. In this way, while the refrigerant imparts heat to the indoor heat exchanger 8, heat is imparted from the outdoor heat exchangers 23, 24. Subsequently, the gasified refrigerant passes through the four-way valve 4 and reaches the accumulator 26. The accumulator 26 separates the gaseous refrigerant and the atomized refrigerant and fully gasifies the refrigerant. If the refrigerant remaining in the atomized state returns to the compressors 1, 2, sliding parts of the compressors 1, 2 may be damaged. The accumulator 26 also plays a role of preventing such a situation. Subsequently, the refrigerant gas passing through the accumulator 26 flows into intake ports of the compressors 1, 2.

If the third electronic expansion valve 35 is partially or completely opened under the control of the controller 60, a portion of the liquid refrigerant passing through the subcooling heat exchanger 18 is atomized by the third electronic expansion valve 35 before flowing into the sub-evaporator 27. To the sub-evaporator 27, warm cooling water (cooling water at 60° C. to 90° C.) of the gas engine is introduced.

The atomized liquid refrigerant flowing into the sub-evaporator 27 indirectly exchanges heat with the warm cooling water and becomes a gas before reaching the accumulator 26. In this way, the performance of giving and receiving heat is improved. It is noted the when the heating operation is performed, the fourth electronic expansion valve 36 is controlled to be fully closed.

On the other hand, in the cooling operation, the controller 60 controls the four-way valve 4 to connect the first port 30 and the third port 32 of the four-way valve 4 and connect the second port 31 and the fourth port 33. A flow of heat in the case of cooling will hereinafter simply be described.

In the case of the cooling operation, the gas refrigerant discharged from the first and second compressors 1, 2 passes through the oil separator 3, then passes through the four-way valve 4, and reaches the first and second outdoor heat exchangers 23, 24. In this case, since the temperature of the refrigerant is high, the refrigerant is cooled even with an intensely hot summer air (air at 30 to 40 degrees C.) by the first and second outdoor heat exchangers 23, 24. The gas refrigerant is deprived of heat by the first and second outdoor heat exchangers 23, 24, turning into a liquid refrigerant.

During the cooling operation, the controller 60 controls the opening degrees of the first and second electronic expansion valves 20, 21 to an appropriate opening degree and controls the electromagnetic valve 38 to be fully opened. The liquid refrigerant passing through the first and second outdoor heat exchangers 23, 24 basically passes through the electromagnetic valve 38 and the check valve 39 and reaches the receiver 17. Subsequently, the liquid refrigerant goes through the bottom of the receiver 17, passes through the subcooling heat exchanger 18, and flows from between the second check valve 12 and the first check valve 11 toward the liquid-side stop valve 10.

Subsequently, the liquid refrigerant flows via the liquid-side stop valve 10 and the liquid-side filter 9 into the indoor heat exchanger 8. The low temperature liquid refrigerant flowing into the indoor heat exchanger 8 draws heat from the indoor heat exchanger 8 to cool a room air while gasifying due to the heat given from the indoor heat exchanger 8. In this way, the refrigerant draws heat from the indoor heat exchanger 8 while releasing heat to the first and second outdoor heat exchangers 23, 24. Subsequently, the gasified gas refrigerant passes through the gas-side filter 6, the gas-side stop valve 5, the four-way valve 4, and the accumulator 26 in this order and flows into the intake ports of the compressors 1, 2.

When the controller 60 receives a signal from a remote control operation by a user via a controller (not shown) and a signal line (not shown) of the indoor unit 100 in hot summer season etc., the controller 60 controls the opening degree of the fourth electronic expansion valve 36 to an appropriate opening degree. As a result, a portion of the liquid refrigerant passing through the receiver 17 and the subcooling heat exchanger 18 is cooled by passing through the fourth electronic expansion valve 36 and flows into the subcooling heat exchanger 18. In this way, heat is exchanged between the liquid refrigerant flowing from the receiver 17 into the subcooling heat exchanger 18 without passing through the fourth electronic expansion valve 36 and the liquid refrigerant passing through the fourth electronic expansion valve 36 and flowing into the subcooling heat exchanger 18. As a result, while the liquid refrigerant sent to the indoor heat exchanger 8 is further cooled, the liquid refrigerant passing through the fourth electronic expansion valve 36 is warmed and gasified before being allowed to flow toward the compressors 1, 2.

Figure 2:
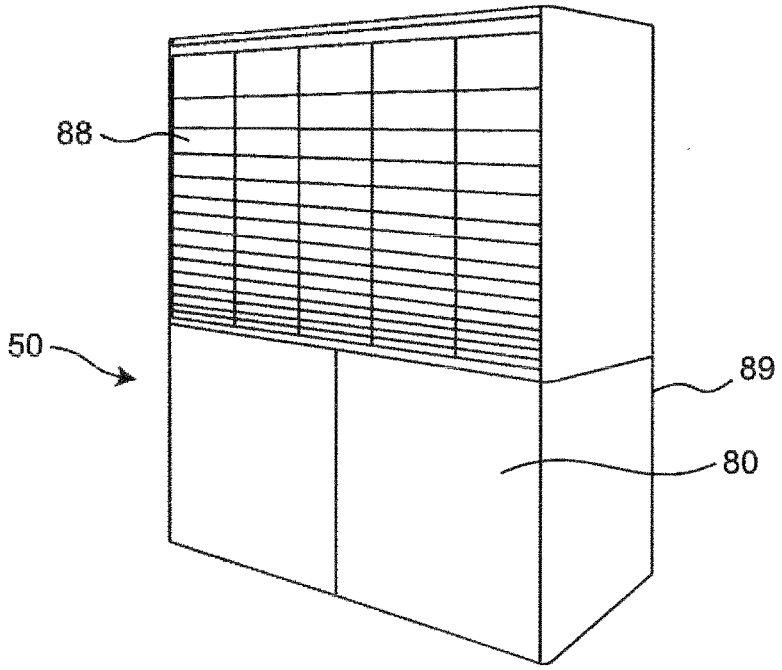
FIG. 2 is a schematic of a package of an outdoor unit.
Figure 3:
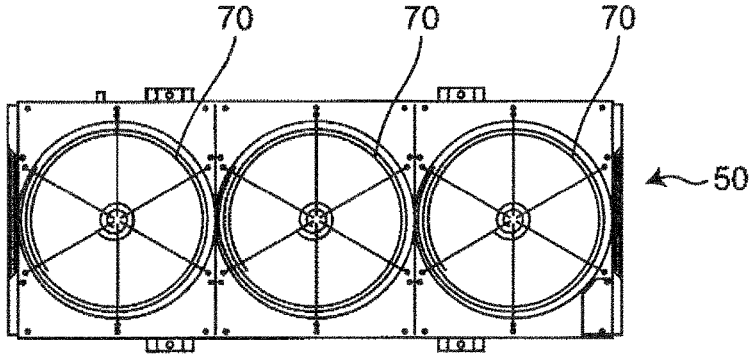
FIG. 3 is a view of the outdoor unit viewed from an upper portion.

FIG. 2 is a schematic of the package 80 of the outdoor unit 50. FIG. 3 is a view of the outdoor unit 50 viewed from an upper portion.

Referring to FIG. 2, in the inside of the package 80, the first and second outdoor heat exchangers 23, 24 (see FIG. 1) are arranged in the upper half, and almost all the other parts (the compressors 1, 2 (see FIG. 1) etc.) are arranged in the lower half. Referring to FIG. 2, in the inside of the package 80, control components are mainly arranged on the near side of the plane of FIG. 2, while various valves etc. are mainly disposed on the far side. On a side plate part (a portion of side plates of the package 80) 89 on the back side not visible in FIG. 2, the package 80 has a connection port for sending the refrigerant to the indoor unit 100 and a connection port for receiving the refrigerant from the indoor unit 100. Referring to FIG. 2, a side surface 88 of the upper portion of the package 80 has a structure allowing passage of air. The package is configured as a case with a plurality of side plates (or outer plates), for example.

As shown in FIG. 3, the outdoor unit 50 has a plurality of fans 70 arranged in the upper portion of the package 80. A top surface of the outdoor unit 50 has a structure allowing passage of air. By driving the fans 70 to suck air from the side surface 88 of the upper portion of the package 80 and discharge the air from the upper portion of the outdoor unit 50, heat is exchanged between the sucked air and the refrigerant.

Figure 4:
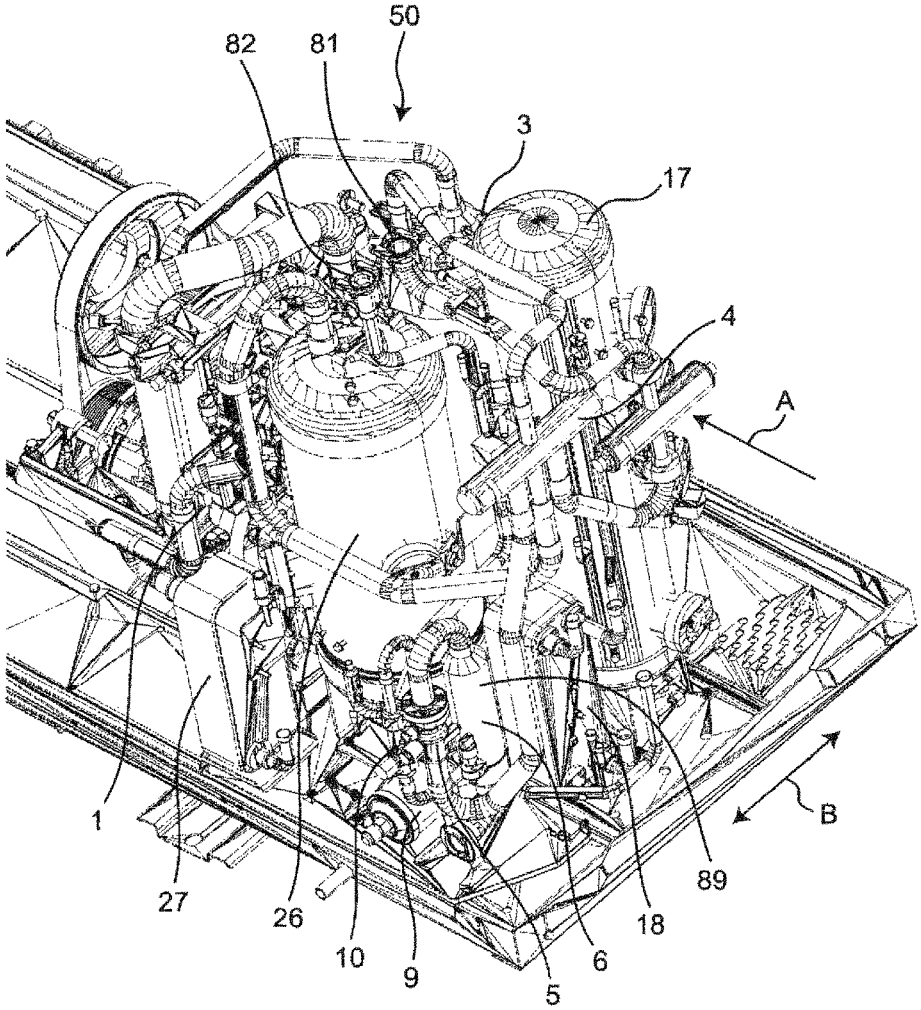
FIG. 4 is a perspective view of the outdoor unit with the package removed and is a perspective view of a portion of an internal structure of the outdoor unit.

FIG. 4 is a perspective view of the outdoor unit 50 with the package 80 removed and is a perspective view of a portion of an internal structure of the outdoor unit 50.

In this perspective view, the oil separator 3, the receiver 17, and the four-way valve 4 are located on the far side of the plane of FIG. 4, while the sub-evaporator 27, the accumulator 26, the one compressor 1 of the two compressors, the liquid-side stop valve 10, the liquid-side filter 9, the gas-side stop valve 5, and the gas-side filter 6 are located on the near side of the plane of FIG. 4.

In FIG. 4, reference numeral 81 denotes an oval flange (oval flange) for connecting the line from the four-way valve 4 to the outdoor heat exchangers 23, 24 (not shown in FIG. 4) disposed on a second floor, and reference numeral 82 denotes an oval flange for connecting the lines from the outdoor heat exchangers 23, 24 to the receiver 17 side. The gas engine (not shown) is disposed on one side in the width direction of the outdoor unit 50 indicated by an arrow A of FIG. 4 relative to the accumulator 26. In other words, the width direction of the outdoor unit 50 is defined as the direction in which the power source of the outdoor unit 50 such as the gas engine is disposed adjacent to the outdoor unit 50.

Figure 5:
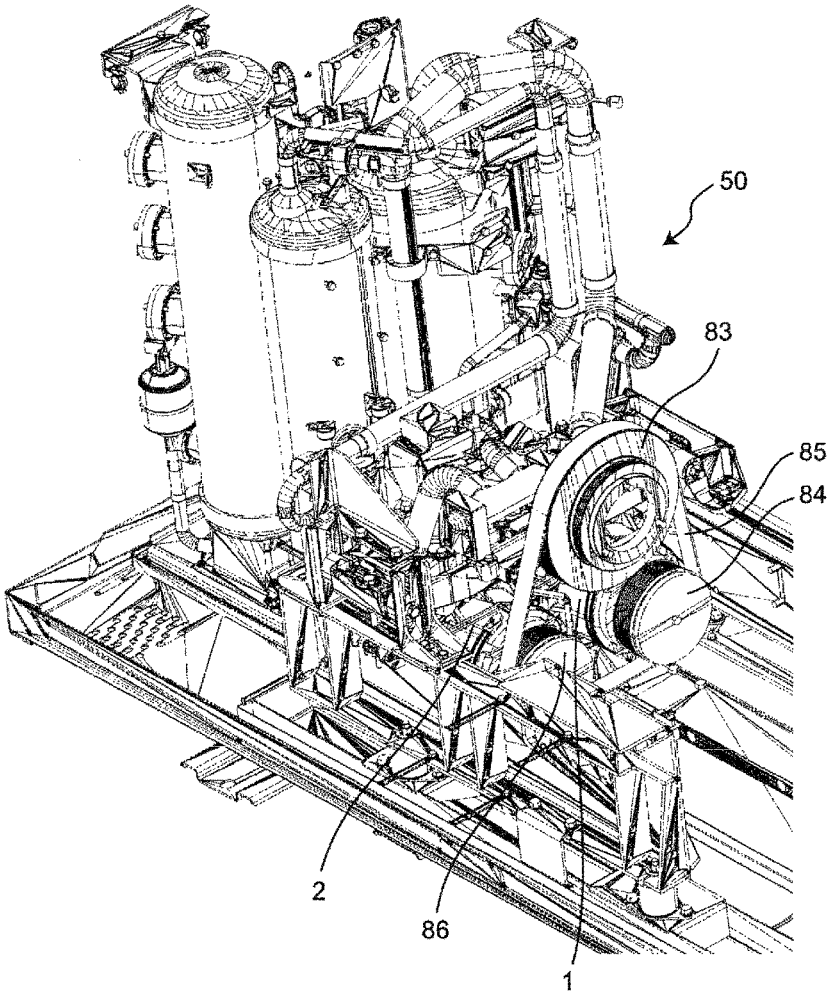
FIG. 5 is a perspective view of a portion of the outdoor unit with the package removed when viewed from a gas engine mounting side.

FIG. 5 is a perspective view of a portion of the outdoor unit 50 with the package 80 removed when viewed from a gas engine mounting side.

In FIG. 5, reference numeral 83 denotes a flywheel of the gas engine; reference numeral 84 denotes an electromagnetic clutch connecting and discontenting a power to the first compressor 1; reference numeral 85 denotes a winding belt; and reference numeral 86 denotes an electromagnetic clutch connecting and discontenting a power to the second compressor 2. As shown in FIG. 5, the winding belt 85 is wound around the flywheel 83, the electromagnetic clutch 84, and the electromagnetic clutch 86. The rotating power of the gas engine is transmitted through the flywheel 83 and the winding belt 85 to the electromagnetic clutches 84, 86 and the rotating power is transmitted from the electromagnetic clutches 84, 86 to the compressors 1, 2.

Figure 6:
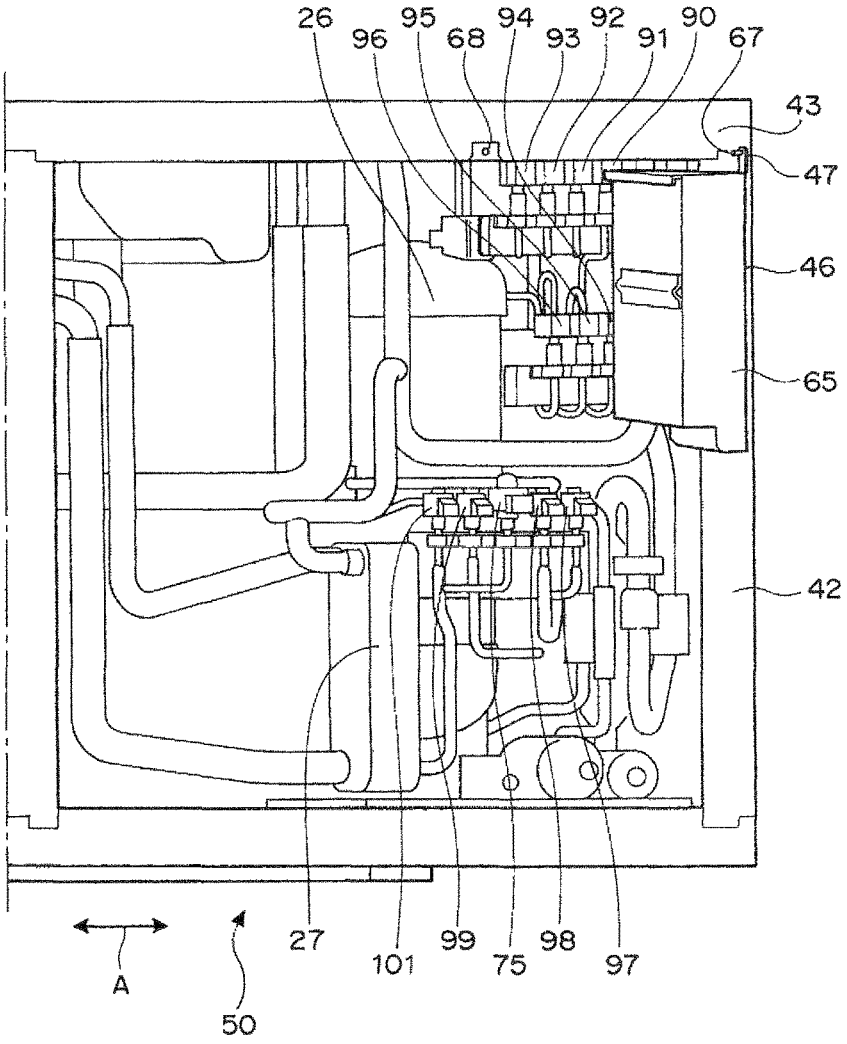
FIG. 6 is a perspective view of a portion of the outdoor unit with a side plate part on a back side of a compressor shown in FIG. 2 removed when viewed from the far side of the plane of FIG. 2 and is a view when a terminal block box is located at an opened position.

FIG. 6 is a perspective view of a portion of the outdoor unit 50 with the side plate part 89 on the back side of the outdoor unit 50 shown in FIG. 2 removed when viewed from the far side of the plane of FIG. 2 and is a view when a terminal block box 65 is located at an opened position. When the terminal block box 65 is located at the opened position, the terminal block box 65 extends in the depth direction of the outdoor unit 50.

As shown in FIG. 6, the outdoor unit 50 has the terminal block box 65, and the terminal block box 65 houses a terminal block for supplying an electric power to the electrical devices 4, 20, 21, 35, 36, 38 (see FIG. 1) etc. As shown in FIG. 6, the terminal block box 65 is located on the sub-evaporator 27 side in the depth direction (indicated by an arrow B of FIG. 4). As described above, the outdoor heat exchangers 23, 24 are arranged on the second floor in the package. The terminal block box 65 is arranged in an upper portion of the first floor in the height direction. The terminal block box 65 is located at an end portion on the side opposite to the gas engine side in the width direction of the outdoor unit 50 indicated by an arrow A of FIG. 6.

The outdoor unit 50 includes a frame 42 extending in the height direction. The frame 42 is located on the sub-evaporator 27 side in the depth direction (indicated by the arrow B of FIG. 4) and is located at the end portion on the side opposite to the gas engine side in the width direction. The terminal block box 65 is supported and made rotatable in the horizontal direction by a hinge structure 45 on the frame 42.

The outdoor unit 50 includes a frame 43 extending in the horizontal direction. The frame 43 is a frame partitioning (separating) the first floor and the second floor. The frame 43 is located on the sub-evaporator 27 side in the depth direction. As shown in FIG. 6, an upper edge portion of the terminal block box 65 is located with a slight clearance to the frame 43 in the height direction.

At the opened position shown in FIG. 6, a normal direction of a surface 46 of the terminal block box 65 is substantially coincident with the width direction indicated by the arrow A. In FIG. 6, reference numerals 90 to 99, 101 denote electromagnetic valves, and reference numeral 75 denotes an electronic expansion valve. The electromagnetic valves 38, 90 to 99, 101 described above are on-off valves. Although not shown in the refrigerant circuit diagram of FIG. 1, the heat pump has valves and lines for returning the lubricating oil of the compressors 1, 2 accumulated in the oil separator 3 to the compressors 1, 2. Additionally, although not described in detail, the heat pump has various valves and lines for allowing the refrigerant and the lubricating oil to flow from one outdoor unit to the other outdoor unit when the two outdoor units are connected, other than the valves and the lines shown in the refrigerant circuit diagram of FIG. 1. These electromagnetic valves 90 to 99, 101 and the electronic expansion valve 75 are some of the plurality of valves not shown in the refrigerant circuit diagram of FIG. 1.

The compressors 1, 2 (see FIG. 1), the outdoor heat exchangers 23, 24 (see FIG. 1), and the plurality of the electrical devices 90 to 99, 101, 75, etc. are housed in the package 80. As shown in FIG. 6, the volume of the electronic expansion valve 75 is larger than the volumes of the electromagnetic valves 90 to 99, 101. The electromagnetic valves 90 to 96 are present at positions higher than the electromagnetic valves 97 to 99, 101. The electromagnetic valves 90 to 96 are present at a position higher than the electronic expansion valve 75.

As shown in FIG. 6, when the terminal block box 65 is located at the opened position, the electromagnetic valves 90 to 96 are exposed to the outside (facing the outside). In this state, a user can access the electromagnetic valves 90 to 96 and can perform maintenance of at least one of the electromagnetic valves 90 to 96.

Figure 7:
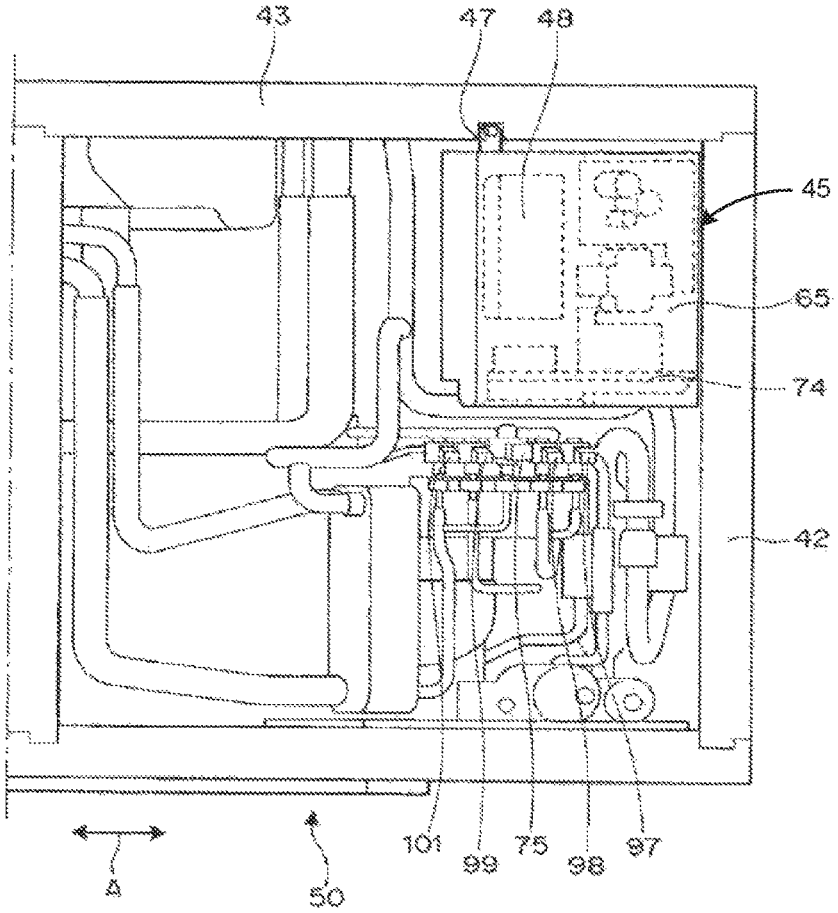
FIG. 7 is a perspective view of the portion of the outdoor unit with the side plate part on the back side of the compressor shown in FIG. 2 removed when viewed from the far side of the plane of FIG. 2 and is a view when the terminal block box is located at a closed position.

FIG. 7 is a perspective view of the portion of the outdoor unit 50 with the side plate part 89 on the back side of the compressor 50 shown in FIG. 2 removed when viewed from the far side of the plane of FIG. 2 and is a view when the terminal block box 65 is located at a closed position. When the terminal block box 65 is located at the closed position, the terminal block box 65 extends in the width direction of the outdoor unit 50.

As shown in FIG. 7, the terminal block box 65 houses a terminal block 74. The terminal block 74 is used for supplying an electric power to at least one electrical device mounted on the outdoor unit 50.

At the closed position shown in FIG. 7, the electromagnetic valves 90 to 96 overlap the terminal block box 65 in the depth direction (the normal direction of the side plate part 89 (see FIG. 2) of the package 80 (see FIG. 2)). On the other hand, the electromagnetic valves 97 to 99, 101 and the electronic expansion valve 75 are located at an interval in the height direction from the terminal block box 65. Even in the closed position shown in FIG. 7, the electromagnetic valves 97 to 99, 101 and the electronic expansion valve 75 do not overlap with the terminal block box 65 in the depth direction.

Referring to FIG. 6, the presence range in the height direction of the terminal block box 65 overlaps with the presence range in the height direction of some electrical devices 90 to 96 of the plurality of the electrical devices 90 to 99, 101, 75, etc. The terminal block box 65 is located closer than these electrical devices 90 to 96 to the side plate part 89 (see FIG. 2) of the package 80. The terminal block box 65 can face these electrical devices 90 to 96 in the normal direction of the side plate part 89 of the package 80 via only a clearance without any member or part interposed therebetween.

As shown in FIG. 6, while the terminal block box 65 is located at the opened position with the package 80 of the outdoor unit 50 (i.e., a portion of the side plate parts constituting the package 80) removed, the outdoor unit 50 has the one or more electromagnetic valves 90 to 99, 101 facing the outside and the one electronic expansion valve 75 facing the outside, on the side disposed with the terminal block box 65 in the depth direction.

Some electrical devices capable of facing the terminal block box 65 via only a clearance have a plurality of the electromagnetic valves 90 to 96 facing the outside. The terminal block box 65 is located at a position higher than the electronic expansion valve 75 facing the outside.

As shown in FIG. 7, the heat pump has a remote monitoring apparatus 48, and the remote monitoring apparatus 48 is housed in the terminal block box 65. The remote monitoring apparatus 48 transmits a signal indicative of states of several devices to the outside of the heat pump by wire or wireless. By way of example, the remote monitoring apparatus 48 has a timer that is not reset. The remote monitoring apparatus 48 receives a signal from a sensor capable of detecting the driving of the heat pump such as a rotation speed sensor disposed on a driving shaft of the gas engine. The remote monitoring apparatus 48 measures the total driving time of the heat pump by using the signal and the timer. The remote monitoring apparatus 48 transmits a signal indicative of the total driving time to the outside. This signal is used for determination etc. of a gas engine oil change time etc.

As shown in FIG. 6, a locking tool 47 is fixed to the terminal block box 65. The locking tool 47 extends upward in the height direction from an upper end portion of the terminal block box 65. The locking tool 47 has a substantially cylindrical locking part 67, and the locking part 67 extends in the thickness direction of the terminal block box 65.

The locking part 67 overlaps in the horizontal direction with the frame 43 extending in the width direction. The frame 43 has a cylindrical hole 68. The cylindrical hole 68 has a shape corresponding to the locking part 67 and exists at a height where the locking part 67 is present. As shown in FIG. 7, at the closed position of the terminal block box 65, the locking part 67 is locked to the cylindrical hole 68. When the terminal block box 65 is located at the closed position, the terminal block box 65 extends in the width direction, and the package 80 can be mounted. In this way, disposing the terminal block box 65 in the upper portion is preferable because the terminal block box 65 can not only be supported and made rotatable in the horizontal direction by the hinge structure 45 on the frame 42 but also be locked to the upper portion of the upper frame 43 extending in the width direction.

Referring to FIG. 7, the side plate part 89 of the package 80 is arranged close to the terminal block box 65. Specifically, the side plate part 89 of the package 80 is detachably attached to the same frames 42, 43 as the frames 42, 43 on which the terminal block box 65 is supported. Unless the terminal block box 65 is located at the closed position shown in FIG. 7, the side plate part 89 of the package 80 cannot be attached to the frames 42 and 43. In other words, unless the side plate part 89 of the package 80 is removed, the terminal block box 65 cannot be turned.

While the side plate part 89 of the package 80 is attached, the terminal block box 65 faces the side plate part 89 via only a clearance and extends in a direction along the side plate part 89. At the closed position shown in FIG. 7, the terminal block box 65 is located in a sandwiched manner between the side plate part 89 of the package 80 and some electrical devices 90 to 96.

According to the embodiment, since the terminal block box 65 is located between the side plate part 89 of the package 80 and some electrical devices 90 to 96 located on the side plate part 89 side, and the terminal block box 65 is supported and made rotatable in the horizontal direction by the hinge, these electrical devices 90 to 96 can easily be exposed to the outside by simply properly rotating the terminal block box 65. Therefore, by simply properly rotating the terminal block box 65, the user can easily access these electrical devices 90 to 96 and may easily perform the maintenance of these electrical devices 90 to 96.

According to the embodiment, since the remote monitoring apparatus 48 is housed in the terminal block box 65, it is not necessary to newly provide an arrangement space of the remote monitoring apparatus 48 in an arrangement space of various electrical devices having large volumes. Therefore, the arrangement space of various electrical devices can be made smaller. Additionally, since the remote monitoring apparatus is housed in the terminal block box 65, the arrangement position of the remote monitoring apparatus 48 can easily be identified, and the maintenance of the remote monitoring apparatus 48 can easily be performed.

Since the electronic expansion valve 75 expands the refrigerant, dew condensation easily occurs on the surface of the electronic expansion valve 75. The volume of the electronic expansion valve 75 is larger than the volumes of the electromagnetic valves 90 to 99, 101, etc. According to the embodiment, since all the electronic expansion valves 75 (the only one in this embodiment) capable of facing the outside with the side plate part 89 removed (including those capable of facing the outside with the terminal block box 65 located at the opened position) are present below the terminal block box 65, the moisture sensitive electronic components mounted on the terminal block box 65 and a larger number of the electrical devices 90 to 96 can be located at positions higher than the electronic expansion valves 75 facing the outside. Therefore, the electronic components mounted on the terminal block box 65 and a large number of the electrical devices 90 to 96 can be protected from the dew condensation generated on the surface of the electronic expansion valves 75 facing the outside.

According to the above embodiment, when the terminal block box 65 is at the closed position, the devices facing the terminal block box 65 via only a clearance include the electromagnetic valves 90 to 96, while the electronic expansion valve 75 is not included. Therefore, the electromagnetic valves 90 to 96 and the electronic expansion valves 75 can easily be identified, and maintenance of a specific valve can easily be performed.

According to the above embodiment, since the electronic expansion valve 75 having a volume larger than those of the electromagnetic valves 90 to 99, 101 is not present at a position that is on the terminal block box 65 side and that is capable of facing the terminal block box 65, the side plate part 89 can be suppressed in dimension in the normal direction (depth direction), so that the outdoor unit 50 can be made more compact.

If an electronic expansion valve having a large volume is present at a position that is on the terminal block box side and that is capable of facing the terminal block box, the terminal block box is further arranged outside the electronic expansion valve, so that the outdoor unit may be increased in size in the depth direction (the thickness direction of the terminal block box at the closed position).

In the embodiment, the remote monitoring apparatus 48 is housed in the terminal block box 65; however, in the present invention, the remote monitoring apparatus may not be housed in the terminal block box.

In the above embodiment, the terminal block box 65 can be locked to the frame 43 extending in the horizontal direction separating the first floor and the second floor and is disposed in the upper portion on the first floor. However, in the present invention, the terminal block box may be disposed in the lower portion on the first floor.

In the embodiment, the electronic expansion valve is not included in the electrical components capable of facing the terminal block box 65 via only a clearance without any member or part interposed therebetween. However, in the present invention, the electronic expansion valve may be included in the electrical components capable of facing the terminal block box 65 via only a clearance without any member or part interposed therebetween.

In the above embodiment, while the side plate part 89 of the package of the outdoor unit 50 is removed and the terminal block box 65 is positioned at the opened position, the outdoor unit 50 has a plurality of the electromagnetic valves 90 to 99, 101 facing the outside and the one electronic expansion valve 75 facing the outside on the side disposed with the terminal block box 65 in the depth direction. However, in the present invention, while the package of the outdoor unit is removed and the terminal block box is positioned at the opened position, the outdoor unit may have only one electromagnetic valve facing the terminal block box in the depth direction and facing the outside on the side disposed with the terminal block box in the depth direction (the normal direction of the side plate on the terminal block box side of the package). The outdoor unit may have a plurality of electronic expansion valves located at an interval in the height direction from the terminal block box on the side disposed with the terminal block box in the depth direction (the normal direction of the side plate on the terminal block box side of the package).

In the embodiment, the heat pump has the one outdoor unit 50 and the one indoor unit 100. However, in the present invention, the heat pump may have any number of one or more outdoor units and may have any number of one or more indoor units.

In the embodiment, the heat pump is a gas-engine-driven heat pump, however, the heat pump of the present invention may be a heat pump driven by an engine other than a gas engine, such as a diesel engine and a gasoline engine. The heat pump of the present invention may be an electrically-driven heat pump.

In the present invention, the terminal block housed in the terminal block box may be for supplying an electric power to all the electrical devices or may be for supplying an electric power only to some of the electrical devices. The terminal block housed in the terminal block box may be for supplying an electric power to at least one electrical device.

In the embodiment, the outdoor heat exchangers 23, 24 have a structure of sucking air from the side surface and discharging the air from the upper portion; however, in the present invention, the outdoor heat exchanger may suck air from any portion and may discharge the air from any portion.

The terminal block box 65 is pivoted within the range from the closed position to the opened position; however, the pivoting range is not limited to the angle range of about 90 degrees and, for example, the rotation range may be set to such an angle range exceeding 90 degrees.

In the present invention, in comparison with the embodiment, one or more electrical components and parts can appropriately be omitted from the electrical components and parts constituting the embodiment. On the contrary, in the present invention, in comparison with the embodiment, a further electrical component or part can be added to the electrical components and parts constituting the embodiment.

In the present invention, a compressor power source such as an engine and an electric motor may be separated from a compressor by a sill so as to prevent the hot heat of the compressor power source from going to the refrigerant side, or a compressor power source such as an engine and an electric motor may not be separated from a compressor by a sill. Additionally, a new embodiment can obviously be constructed by combining two or more constituent elements out of all the constituent elements described in the embodiment and modification examples.

Although the present invention has been sufficiently described in terms of the preferable embodiment with reference to the accompanying drawings, various variations and modifications are apparent to those skilled in the art. It should be understood that such variations and modifications are included in the present invention without departing from the scope of the present invention according to appended claims.

The disclosures of description, drawings, and claims of Japanese Patent Application No. 2014-237142 filed on Nov. 21, 2014 are incorporated herein by reference in their entirety.

EXPLANATIONS OF REFERENCE OR NUMBERS

1 first compressor
2 second compressor
3 oil separator
4 four-way valve
6 gas side filter
8 indoor heat exchanger
9 liquid-side filter
10 liquid-side stop valve
17 receiver
18 subcooling heat exchanger
20 first electronic expansion valve
21 second electronic expansion valve
23 first outdoor heat exchanger
24 second outdoor heat exchanger
26 accumulator
27 sub-evaporator
35 third electronic expansion valve
36 fourth electronic expansion valve
38 electromagnetic valve
48 remote monitoring apparatus
50 outdoor unit
60 controller
65 terminal block box
74 terminal block
75 electronic expansion valve
80 package
83 flywheel
89 side plate part (portion of side plates of a package)
90 to 99, 101 electromagnetic valve
100 indoor unit
110 gas refrigerant pipe
120 liquid refrigerant pipe

The invention claimed is:

1. A heat pump having an outdoor unit with a compressor, an outdoor heat exchanger, and a plurality of electrical devices including a plurality of on-off valves and a plurality of expansion valves housed in a package, the heat pump comprising:

a terminal block box housing a terminal block for supplying an electric power to at least one of the electrical devices, wherein the terminal block box is located between a portion of side plates of the package and some of the plurality of electrical devices located on the side of the portion of the side plates, and the terminal block box is supported and made rotatable in a horizontal direction by a hinge, and when the terminal block box is located at an open position, the on-off valves of the electrical devices are exposed to the outside, and the terminal block box is located at a position higher than the plurality of expansion valves of the electrical devices.

2. The heat pump according to claim 1, wherein a remote monitoring apparatus is housed in the terminal block box.

3. An outdoor unit of a heat pump, the outdoor unit comprising:

a package comprising a plurality of side plates configured to define a chamber, wherein a compressor and a heat exchanger are included in the chamber;

a plurality of electrical devices included in the chamber, the plurality of electrical devices configured to be positioned between a first side plate of the plurality of side plates and a second side plate of the plurality of side plates, the plurality of electrical devices comprising:

a plurality of on-off valves; and a plurality of expansion valves;

a terminal block via which electric power is supplied to at least one of the electrical devices; and a terminal block box defining a housing in which the terminal block is located, the terminal block box is located at a position higher than the plurality of expansion valves and is configured to be rotatable in a horizontal direction between a closed position and an open position;

wherein, when the terminal block is in the closed position, the terminal block box is configured to be positioned intermediate the first side plate and at least one of the plurality of on-off valves such that the terminal block box fills an opening and the at least one of the plurality of on-off valves is inaccessible via the opening; and wherein, when the terminal block is in the open position, the at least one of the plurality of on-off valves is accessible via the opening.

4. The outdoor unit of claim 3, further comprising a remote monitoring apparatus located within the housing of the terminal block box.

5. The outdoor unit of claim 3, wherein the package further comprises a frame having a vertical portion and a horizontal portion coupled to the vertical portion, the first side plate configured to be removably coupled to the frame.

6. The outdoor unit of claim 5, wherein the terminal block box is coupled to the vertical portion of the frame via a hinge, the hinge configured to support the terminal block box and enable rotation of the terminal block box in the horizontal direction.

7. The outdoor unit of claim 6, wherein the terminal block box is configured to be releasably coupled to the horizontal portion of the frame.

8. The outdoor unit of claim 6, further comprising means for releasably coupling the terminal block box to the horizontal portion of the frame.

9. The outdoor unit of claim 6, wherein:

the horizontal portion of the frame includes a hole; and the terminal block box includes a locking tool configured to releasably engage with the hole, wherein, in the closed position, the locking tool is engaged with the hole, and wherein, in the open position, the locking tool is disengaged with the hole.

10. The outdoor unit of claim 3, wherein the terminal block box is located at the position higher than the plurality of expansion valves to protect electronic components housed in the terminal block box from condensation corresponding to the plurality of expansion valves.

* * * * *